United States Patent [19]

Arnoux

[11] 4,390,288

[45] Jun. 28, 1983

[54] WATCH CASING

[75] Inventor: Jean Arnoux, Le Noirmont, Switzerland

[73] Assignee: Cesar Arnoux, S.A., Le-Noirmont, Switzerland

[21] Appl. No.: 361,529

[22] Filed: Mar. 23, 1982

[51] Int. Cl.[3] ..... G04B 37/00

[52] U.S. Cl. ..... 368/276; 368/281; 368/294

[58] Field of Search ..... 368/276, 281, 282, 294, 368/295, 296; 206/301, 18

[56] References Cited

U.S. PATENT DOCUMENTS

| | | | |
|---|---|---|---|
| 2,221,206 | 11/1940 | Schwankhaus | 368/281 |
| 2,230,330 | 2/1941 | Marti | 368/281 X |
| 2,252,647 | 8/1941 | Schmitz | 368/294 |
| 2,344,422 | 3/1944 | Sickinger | 368/282 X |
| 3,307,346 | 3/1967 | Klingenberg | 368/294 |
| 3,545,198 | 12/1970 | Loftus | 368/281 |
| 3,910,031 | 10/1975 | Keida | 368/281 |
| 4,034,552 | 7/1977 | Davidson | 368/282 X |

FOREIGN PATENT DOCUMENTS

| | | | |
|---|---|---|---|
| 449286 | 8/1949 | Italy | 368/282 |

*Primary Examiner*—Ulysses Weldon
*Attorney, Agent, or Firm*—Silverman, Cass & Singer

[57] ABSTRACT

The casing comprises a body and two glasses one of which plays the role of the bottom. These two glasses are pressed against the body by eight clamps having the shape of stirrups overlapping the horns of the attachment elements of the wristlet. Each pair of clamps is traversed by two screws, one engaged from above, the other one engaged from underneath ensuring the tightening. Clamps are provided with shoulders by means of which they bear on bevels on the two glasses.

10 Claims, 9 Drawing Figures

WATCH CASING

BACKGROUND OF THE INVENTION

The present invention relates to a watch-casing.

The tight assembling on the elements of watch-casings has given raise to numerous constructive solutions. The utilization of glasses made of an extra hard material (sapphire, hardened glass, etc.) has rendered this problem specially difficult to be solved.

SUMMARY OF THE INVENTION

The purpose of the present invention is to furnish a specially neat solution to the problem of the assembling of the elements of a watch-casing which is specially adapted to the case of glasses made of extra-hard material and which, at the same time, gives also a solution to the problem of the mounting of the glass and of the bottom, even when the latter is constituted, on its side, by a glass made of an extra-hard material.

This object and the effects mentioned hereabove are reached owing to the fact that the watch-casing according to the invention is characterized by the fact that the elements which constitute respectively its upper part and its lower part are secured to the casing body by four pairs of clamps engaging each on one of four outer protrusions of the said casing body, the tightening being ensured by screws traversing each one of the clamps of the said pairs for screwing, at least indirectly, in the other one, that urges the two clamps of each pair to move towards each other, by slipping on the protrusion of the casing body on which they are engaged, thus pressing against the casing body the elements they maintain in place.

The various features of the invention will be apparent from the following description, drawing and claims, the scope of the invention not being limited to the drawing itself as the drawing is only for the purpose of illustrating a way in which the prindciples of the invention can be applied. Other embodiments of the invention utilising the same or equivalent principles may be used and structural changes may be made as desired by those skilled in the art without departing from the present invention and the purview of the appendant claims.

BRIEF DESCRIPTION OF THE DRAWING

The accompanying drawing shows, by way of example, one preferred embodiment of the invention and several modifications.

DETAILED DESCRIPTION OF THE INVENTION

Figure 1:
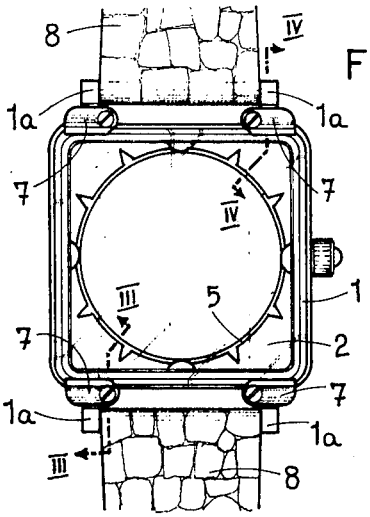
FIG. 1 is a plan view of a casing of a wristwatch, of the type called "skeleton", that is to say the bottom of which is transparent so that the movement be visible.
Figure 2:
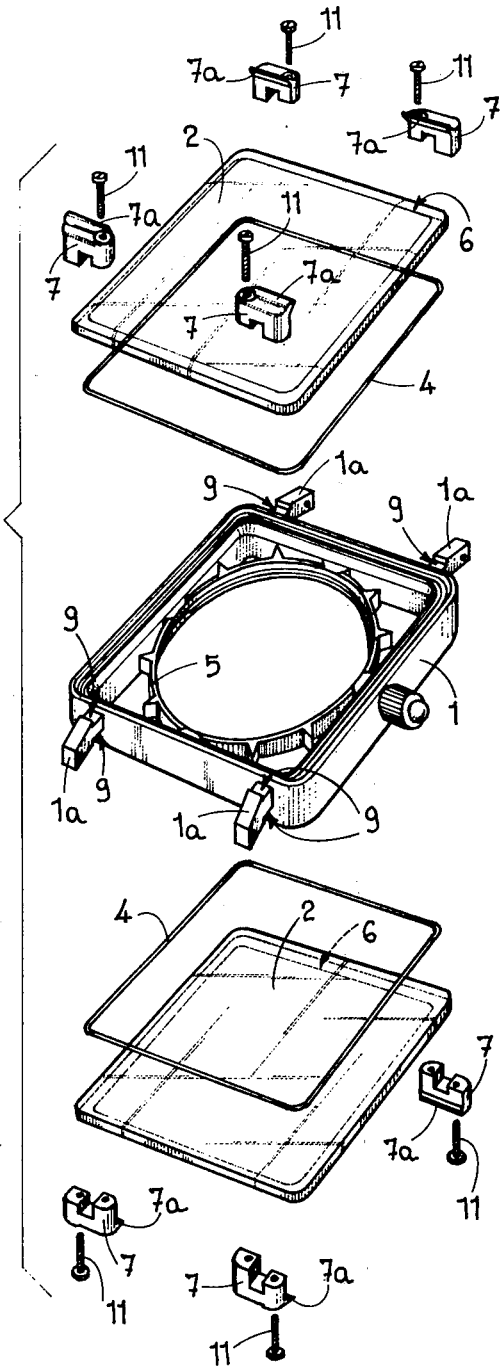
FIG. 2 is an exploded view of the several elements of this casing.
Figure 3:
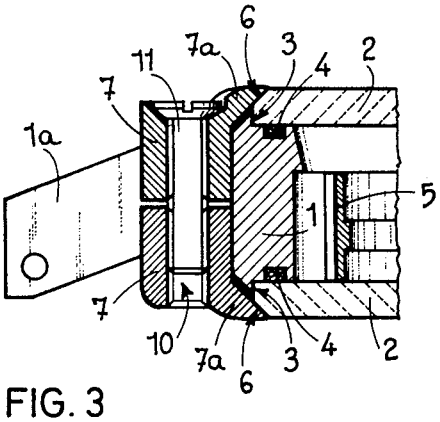
FIG. 3 is a sectional view on the line III—III of FIG. 1, at a larger scale.
Figure 4:
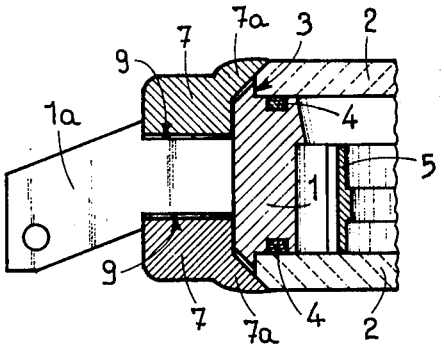
FIG. 4 is a sectional view on the line IV—IV of FIG. 1, at the scale of FIG. 3.

The watch-casing represented in FIGS. 1 to 4, of square shape, comprises a body 1 provided with two glasses 2, the upper one and the lower one. These glasses are each located in one of two fillisters 3 of the body of the casing (FIGS. 3 and 4), that prevents them from moving laterally with respect to the axis of the casing. The two axial faces of the body 1 are each provided with an annular groove in which is located a tight gasket 4. The two tight gaskets are constituted by toric elements of circular cross-section (called O-ring) which, at rest, are partially located each in one of the said grooves. The casing comprises moreover a fitting ring 5 carrying the hour indexes.

The two glasses 2 are each bevelled at 6, the bevels of the two opposed edges acting as a rest surface for the protrusions 7*a* of securing clamps 7. The clamps 7, which have the shape of stirrups or yokes, are in the number of eight and are distributed by pairs, the two clamps of a same pair overlapping each one of the horns, designated by 1*a*, of the attachment members of the wrislet designated by 8. Each horn 1*a* is provided with two notches 9, one on its upper face, the other one on its lower face, in which engages the transversal portion of the corresponding clamp 7. Hence, and due to the fact that the distance separating the forks of the clamps 7 corresponds to the width of the horns 1*a*, the clamps can move in only one direction which is perpendicular to the plane of the watch-casing.

The forks of the clamps 7 are each provided with a longitudinal hole 10 traversed by a securing screw 11. Each pair of clamps has one of its screws which passes freely through one of the clamps and screws in the other one, while its second screw passes freely through the other clamp for screwing in the first one. One could however provide the case where one of the clamps would be traversed freely by the two screws, the latters screwing both in threaded holes of the second clamp. One could also provide the case where, in place of threaded holes in which are directly threaded the screws 11, one could use female screws, of tubular shape, engaging freely the holes of the clamps and in which would be screwed the screws 11.

When the screws 11 are tightened, the clamps 7 of each pair move one towards each other, while slipping on the horn 1*a* they overlap, thus pressing the two glasses on the casing body 1.

Figure 5:
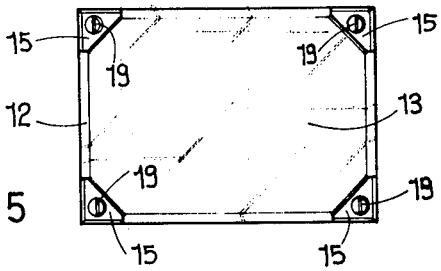
FIG. 5 is a plan view of a modificatin of a watch-casing.
Figure 6:
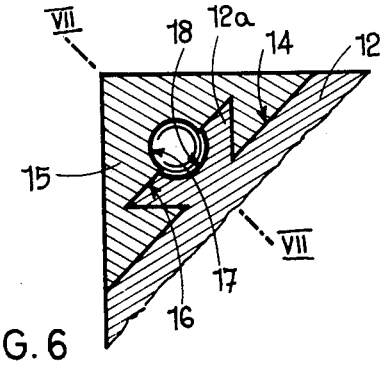
FIG. 6 is a sectional view, in the plan of the watch-casing, of a detail, at a larger scale.
Figure 7:
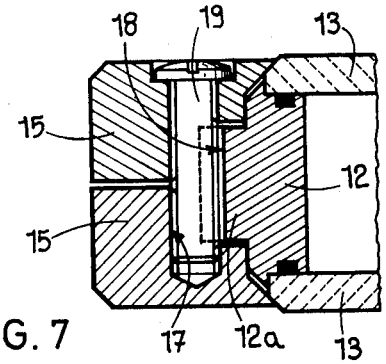
FIG. 7 is a sectional view on the line VII—VII of FIG. 6.

The modification of FIGS. 5 to 7 is constituted by a rectangular casing, the body of which is designated by 12, and which comprises, as in the first embodiment, two glasses designated by 13. The angles of this casing have been cut, that provides, on the body 12, four cut faces 14 (FIG. 6) provided each with a protrusion 12*a*, which, seen from above, is dovetailed, on each of which is engaged a pair of securing clamps 15 for the glasses 13. These clamps have the shape of a parallelepiped having a triangular base, in each of which is provided a recess 16 the cross-section corresponds to the shape of the protrusions 12*a*. It results from this arrangement that the clamps 15 can move in only one direction which is perpendicular to the plane of the casing. Each clamp 15 is provided with a notch 17 the cross-section of which has the shape of an arc-of-circle, constituting, with a notch 18, of the same shape, provided in each protrusion 12*a*, a hole through which passes a securing screw 19. The tightening is effected similarly as this previously disclosed.

Figure 8:
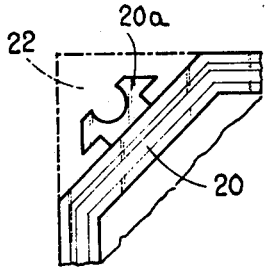
FIGS. 8 and 9 are plan views of a detail of two other modifications.
Figure 9:
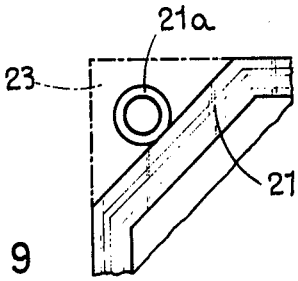

The modifications of FIGS. 8 and 9 distinguish from those of FIGS. 5 to 7 mainly by the shape of the protrusions of the casing body receiving the pairs of securing clamps for the glasses:

In the modification of FIG. 8, the protrusions 20*a*, only one of which has been represnted, of the casing body, designated by 20, are T-shaped while, in the modification of FIG. 9, the protrusions 21*a* of the casing body 21 are constituted by sections of tubes welded to the casing body. The recesses of the securing clamps, indicated in dot-and-dash lines and designated by 22 in FIG. 8 and by 23 in FIG. 9, will have shapes corresponding to these of the protrusions 20*a* and 21*a*, respectively.

The protrusions can have numerous other shapes, seen in plan view. They could also, instead of being placed at the angles of the casing, be situated in the center of the sides of the casing and could also constitute attaching members for a wristlet. They could also be distributed at the periphery of a round casing. The fillisters of the casing body in which are located the glasses could be eliminated, especially in the case of round casings, the clamps being sufficient for centering the glasses.

The invention is not limited to the case of the skeleton watches, in which the bottom is replaced by a glass. It can also be applied to the case of casings having a conventional metalic bottom. It could even be applied to the case where the glass would be provided with a bezel on which, in this case, the securing clamps would then bear rather than bearing on the glass.

I claim:

1. Watch casing having a casing body and comprising upper and lower elements of the casing secured to the casing body by four pairs of clamps engaging each on one of four outer protrusions of the said casing body, the tightening being ensured by screws traversing each one of the clamps in each of the respective pairs to enable the two clamps of each pair to move towards each other by slipping on the protrusion of the casing body on which they are engaged, thus securing to the casing body the respective upper and lower elements.

2. Watch casing as claimed in claim 1, in which the four protrusions of the casing body comprise four respective horns for attachment of a wristlet.

3. Watch casing as claimed in claim 2, in which each horn is provided with two transversal notches, on in its upper face and the other one on its lower face, the securing clamps having the shape of stirrups for overlapping said horns and being partially engaged by median portions thereof in the said notches, so that the said clamps can move only in a direction which is perpendicular to the plane of the casing.

4. Watch casing as claimed in claim 3, in which the portions of the clamps having the shape of stirrups are each provided with a longitudinal hole for one of said screws.

5. Watch casing as claimed in claim 1, of quadrangular shape, in which the four angles of the casing body are cut, the protrusions on which engage the securing clamps protruding on the four cut faces constituted by the four cut angles of the casing body.

6. Watch casing as claimed in claim 1, in which the protrusions of the casing body on which engage the securing clamps are profiled, the said clamps being provided with recesses of corresponding shape, so that they can move only in one direction which is perpendicular to the plane of the casing.

7. Watch casing as claimed in claim 6, in which the said protrusions are each provided with a hole through which passes a tightening screw traversing one of the clamps and screwing, at least indirectly, in the other one.

8. Watch casing as claimed in claim 1, in which the casing body is provided on two axial faces with an annular fillister intended to receive the respective upper and lower elements of the casing, so that these elements are prevented from moving laterally with respect to the axis of the casing.

9. Watch casing as claimed in claim 8, in which the two axial faces of the casing body are each provided with an annular groove in which is partially engaged a tight gasket on wich bears one of the upper and lower elements of the casing.

10. Watch casing as claimed in claim 1, in which the upper and lower elements of the casing are both glasses.

* * * * *

UNITED STATES PATENT AND TRADEMARK OFFICE

CERTIFICATE OF CORRECTION

PATENT NO. : 4,390,288

DATED : June 28, 1983

INVENTOR(S) : Jean Arnoux

It is certified that error appears in the above-identified patent and that said Letters Patent is hereby corrected as shown below:

On the title page Insert

-- (30) Foreign Application Priority Data

March 30, 1981 Switzerland 2136/81 --

Signed and Sealed this

*Third* Day of *January 1984*

[SEAL]

*Attest:*

GERALD J. MOSSINGHOFF

*Attesting Officer* *Commissioner of Patents and Trademarks*